United States Patent [19]

MacLarty et al.

[11] 4,272,900

[45] Jun. 16, 1981

[54] IDENTITY BAND

[75] Inventors: Bernard G. MacLarty, Bedfordview; Bryan Sidders, Germiston, both of South Africa

[73] Assignee: Promex Plastics (Proprietary) Limited, South Africa

[21] Appl. No.: 71,258

[22] Filed: Aug. 30, 1979

Related U.S. Application Data

[63] Continuation-in-part of Ser. No. 811,779, Jun. 30, 1977, abandoned.

[30] Foreign Application Priority Data

Sep. 27, 1976 [ZA] South Africa ..... 76/5777
Mar. 17, 1977 [ZA] South Africa ..... 77/1615

[51] Int. Cl.[3] ..... G09F 03/14

[52] U.S. Cl. ..... 40/21 C; 24/16 PB; 40/2.2

[58] Field of Search ..... 40/21 R, 21 A, 21 B, 40/21 C, 2.2; 24/16 PB, 17 AP

[56] References Cited

U.S. PATENT DOCUMENTS

| | | | |
|---|---|---|---|
| 1,334,358 | 3/1920 | Des Combes | 40/21 R |
| 1,851,491 | 3/1932 | Brown | 40/21 C |
| 2,936,980 | 5/1960 | Rapata | 24/16 PB |
| 3,072,986 | 1/1963 | Lefnaer | 24/16 PB |
| 3,106,028 | 10/1963 | Baumgartner | 24/16 PB X |
| 3,153,869 | 10/1964 | Twentier | 40/21 C |
| 3,283,713 | 11/1966 | Wooster | 40/2.2 X |
| 3,581,349 | 6/1971 | Verspieren | 24/16 PB |
| 3,800,450 | 4/1974 | Laugherty et al. | 40/21 C |
| 3,837,047 | 9/1974 | Bunnell | 24/16 PB |

FOREIGN PATENT DOCUMENTS

| | | | |
|---|---|---|---|
| 1196366 | 6/1970 | United Kingdom | 24/16 PB |
| 1291172 | 10/1972 | United Kingdom | 24/16 PB |
| 1439156 | 6/1976 | United Kingdom | 24/16 PB |

*Primary Examiner*—Gene Mancene
*Assistant Examiner*—G. Lee Skillington

[57] ABSTRACT

An identity band which comprises an elongate strap and a latch portion which forms a slot through which the strap is pushed to form the band into a loop. The strap has a series of apertures therein providing a series of transverse stop surfaces alternating with a series of transverse camming surfaces. Within the slot there is a latching element. As the strap is pushed through the slot to form the loop, the camming surfaces in turn cam the latching element out of the path of the strap to permit passage thereof through the slot. The stop surfaces are arranged so that, if an attempt is made to pull the strap in the opposite direction through the slot, one of them engages with the latching element to prevent such movement of the strap. Both the stop surfaces and the camming surfaces meet the upper and lower faces of the strap portion at angles other than right angles. The latch element is wedge-like and mounted at its thicker end. The band is formed so that it can carry information identifying the person wearing the band.

7 Claims, 5 Drawing Figures

IDENTITY BAND

This application is a continuation-in-part application of U.S. Ser. No. 811,779 filed June 30, 1977, now abandoned.

This invention relates to identity bands such as are worn by patients in hospitals.

BACKGROUND TO THE INVENTION

Various types of identity bands are known. Many of these comprise a combination of plastic straps and metal latching structures for securing them in the form of a loop. These are not considered satisfactory by medical authorities largely because of their metal parts which are capable of causing injury.

Also known to applicant is an injection molded identity band which, while overcoming the problem mentioned above, itself has the disadvantage that it is complex to mold and requires considerable force to draw the strap thereof through a slot provided in a latching structure. This can be disadvantageous considering that these bands must be placed on old people, babies and seriously ill people.

The object of the present invention is to provide an identity band which is inexpensive to produce, requires a minimum of effort to fit it, and otherwise meets the requirements of the medical authorities.

BRIEF SUMMARY OF THE INVENTION

According to the present invention there is provided an identity band comprising an elongate strap portion having a series of apertures therein, each aperture having two spaced apart transverse walls, one transverse wall of each aperture constituting a camming face and the other transverse wall of each aperture constituting a stop face, and a latch portion adjacent one end of the band, the latch portion including a latch portion base and an arch formation including legs normal to the latch portion base and a cross piece parallel to and spaced from the latch portion base, said legs, base and cross piece defining a latching slot for receiving said strap portion, said latch portion base having an aperture therein and there being a displaceable latching element protruding from that one of the transverse walls of this aperture which is remote from said strap portion, said latching element extending into said slot, and said camming faces serving in turn to deflect said latching element out of said slot and into said aperture in said base while said strap portion is being passed through said slot in one directon to form the band into a loop, engagement between said latching element and any one of said stop faces preventing withdrawal of the strap portion from the slot in the opposite direction.

Said latching element can be wedge shaped with its thicker end adjacent said one transverse wall. Preferably the planes in which said transverse walls of the apertures lie intersect the planes of the major faces of said strap portion at angles other than right angles.

In the preferred form the latching element is in the form of a double wedge comprising a first portion adjacent said one transverse wall and a second portion extending from said first portion, the angle of taper of the first portion being greater than the angle of taper of the second portion. To enhance the latching action the surface of the latching element facing said cross-piece is planar, the surface facing said aperture in the latch portion base changing directio where said first and second portions merge.

Another important feature of the invention resides in that the camming faces meet said planes at angles different to the angles at which the stop faces meet said planes. In the preferred embodiment, said camming faces intersect said planes at a lesser angle than do said stop faces.

DESCRIPTION OF THE DRAWINGS

For a better understanding of the present invention, and to show how the same may be carried into effect, reference will now be made, by way of example, to the accompanying drawings, in which.

The identity band illustrated includes a strap 10, a portion 12 for carrying iformation, and a latch structure 14 for holding the band in a closed loop around the wrist of the wearer.

Figure 4:
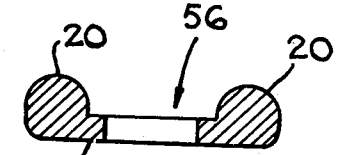
FIG. 4 is a transverse section, also to a larger scale, on the line IV—IV of FIG. 2.

The free end of the strap 10 is shaped so as to provide a thin-sectioned round ended cone 16 which, as will be more fully explained hereinafter, facilitates engagement of the strap with the latch structure 14. Between the cone 16 and the portion 12 the strap 10 is of channel-section (see particularly FIG. 4) having a base 18 and two rounded, upstanding side flanges 20. Both ends of the side flanges 20 merge with the base 18 by way of sloping ramps 22.

The portion 12 is of flattened rectangular cross section. The function of this portion will be described in more detail hereinafter.

The portion 12 lis between the strap 10 and a neck 26 which joins the latch structure 14 to the portion 12.

The base 18 is formed with a series of spaced apertures 56, most of the apertures being equally spaced from one another but there being three apertures 56 adjacent the portion 12 which are closer together than the remainder.

Figure 3:
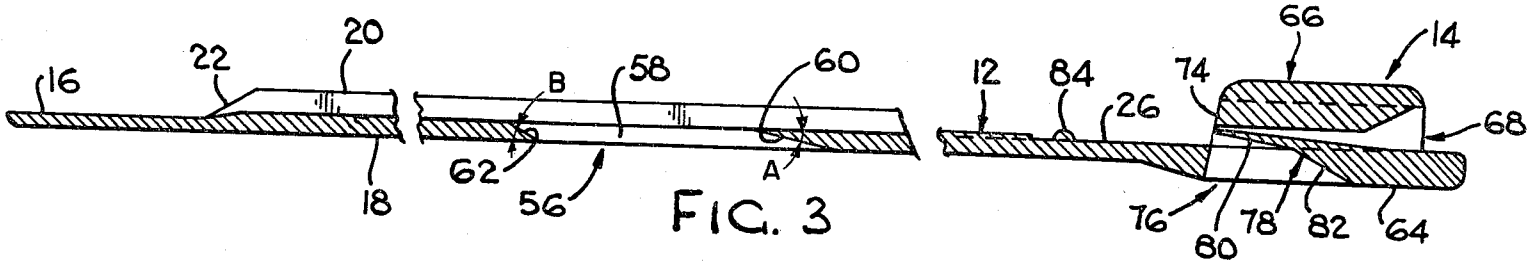
FIG. 3 is a fragmentary longitudinal section, to a larger scale, taken on line III—III of FIG. 1.

Each aperture 56 is bounded by laterally spaced, longitudinally extending side faces 58 and transverse faces 60 and 62. The faces 60 and 62 are inclined with respect to the upper and lower faces of the base 18 as can best be seen in FIG. 3. The faces 60 and 62 do not lie parallel to one another. The face 60, which constitutes a camming face, is somewhat less steeply inclined than the face 62, which constitutes a stop face, and is thus of greater extent. In the preferred form the face 60 lies at an angle of 12 degrees with respect to the horizontal planes containing the upper and lower faces of the base 18 and the face 62 lies at an angle of 30 degrees with respect to said horizontal planes. Thus the included angle A between each face 60 and the horizontal plane containing the upper face of the base 18 is 12 degrees, and the included angle B between the face 62 and the horizontal plane containing the lower face of the base 18 is 30 degrees. Theeffect of inclining the faces 60 and 62 as shown is to make that end of each aperture 56 which is coincident with the lower face of the base 18 wider than that end thereof which is coincident with the upper face of the base. This has the additional effect of displacing the rear edge of the lower end of the aperture rearwardly with respect to the rear edge of the upper end of the aperture.

The latch structure 14 includes a base 64 which is somewhat wider than the neck 26 and an arch 66 which, together with the base 64, defines a slot 68 for receiving the strap 10.

The arch 66 comprises uprights 70 joined by a cross-piece 72, a block 74 being molded onto the underside of the cross-piece 72.

Figure 5:
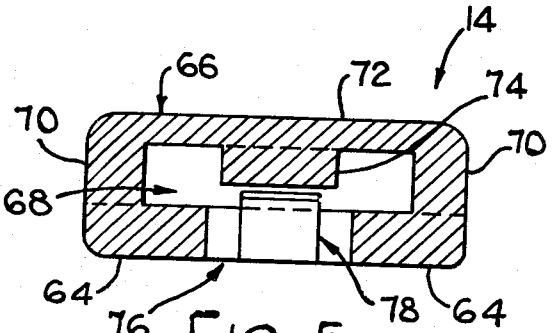
FIG. 5 is a transverse section, to a larger scale, on the line V—V in FIG. 2.

A centrally disposed, rectangular aperture 76 is provided in the base 64. A latching element 78 protrudes from the center of the rear, transverse bounding wall of the aperture 76 and slopes upwardly towards the block 74. The element 78 is in the form of a double wedge and, as can best be seen in FIG. 5, has a relatively thin and tapering free end portion 80 and a tapering portion 82 connecting the portion 80 to the transverse edge of the aperture 76. The wider end of the portion 80 merges with the narrower end of the portion 82. The two portions have a common smooth and uninterrupted upper face. The change in angle of taper results in a lower surface which slopes fairly shallowly (preferably 10 degrees to horizontal) over the length of the portion 80 and more steeply (preferably 30 degrees to horizontal) over the length of the portion 82.

The band illustrated is injection molded. Shrinkage of the plastics material after molding is utilized to ensure that the element 78 'pulls-up' to the position illustrated in FIG. 3. In this position the tip of the element 78 engages, or lies very close to, the underside of the block 74.

A stop is shown at 84.

Figure 1:
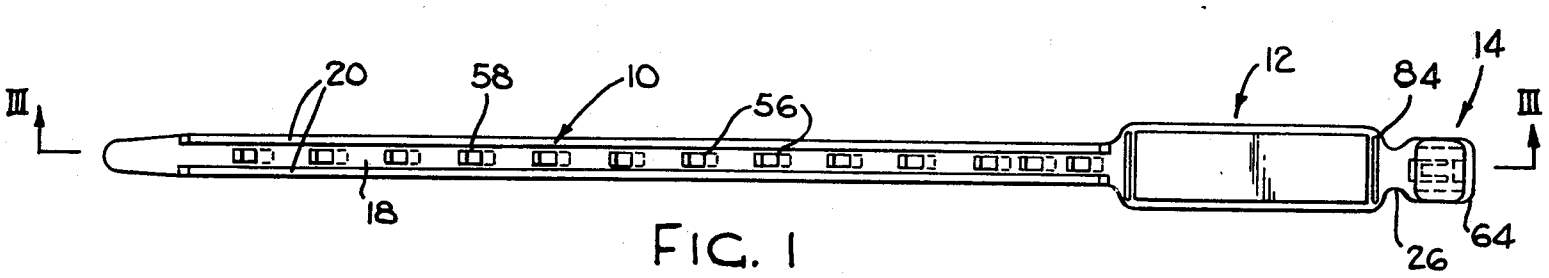
FIG. 1 is a top plan view of an identity band.
Figure 2:
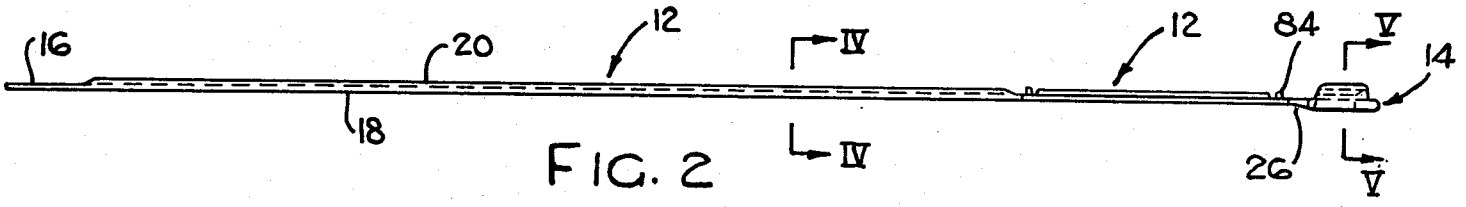
FIG. 2 is a side elevation of the identity band of FIG. 1.

To secure the identity band around a wrist, the band is formed into a loop with the smooth surface thereof (the lower surface in FIG. 2) against the user's skin. The cone 16 is pushed (from the right in FIG. 3) through the slot 68 which is bounded by the base 64, the uprights 70, the cross-piece 72, and the block 74. The flanges 20 are received one on each side of the block 74 and the base 18 passes beneath the block.

As the strap 10 is pushed through the slot 68, the element 78 is cammed by the base 18 downwardly away from the block 74 into the aperture 76 to permit free passage of the strap 10. As the aperture 56 closest to the cone 16 comes into co-operating relationship with the element 78, the element 78 springs into this aperture 56. As the strap 10 is pulled further through the slot 68 the face 60 cams the element 78 downwardly out of the aperture 56 into which it has sprung.

When the desired tightness of the band around the wrist has been achieved, the portion of the strap 10 which protrudes from the left hand end of the slot 68 and overlies the neck 26 and the portion 12 is cut off. The cut end is pressed down behind the stop 84. Any attempt to loosen the band by pulling the strap back in the opposite direction causes engagement between the face 62 of the aperture 56 in which the element 78 is seated and the undersurface of the element 78. The element 78 is thus forced upwardly against the block 74 and hence the strap cannot be removed without destroying the element 78 or tearing the strap 10.

Because of the configuration of the aperture 56 the element 78 can, when the strap is pulled back as described, begin to move upwardly into one of the apertures 56 earlier than it could do if the face 60 sloped as steeply as the face 62. This minimizes the risk that the underside of the base 18 will hold the element 48 down for so long that, when it finally moves upwardly, it strikes the underside of the base 18 on the other side of the aperture 56 and fails to enter the aperture 56 to prevent further movement of the strap in the unlatching direction.

The face 62, when an attempt is made to pull the strap 10 out of the slot 30, bears on the underface face of portion 80. The portions 80 and 82 are thus forced upwardly to bear against the underside of the block 74. The thickness of the tip region of the portion 80 plus the thickness of the base 18 equals the width of the slot 68 measured between the underface of the block 74 and the upper face of the base 64. The slot is thus, at this region, wide enough to receive both the strap 10 and the portion 80. However, the element 78 is somewhat thicker where the portions 80 and 82 merge and the slot 68 is not wide enough to receive both the element 78 and the base 18 without forcing the base 18 downwardly into the aperture 76.

Information concerning the patient is carried on the portion 12. The wrist band illustrated is intended to be injection molded and one surface of the portion 12, that which faces outwardly, can be rough so as to enable information to be written directly onto it. This can be achieved by sandblasting the respective surface of the mold.

As an alternative to writing on the portion 12, a rectangular label of paper, card or cloth can be secured, e.g., gummed, to the portion 12 and a transparent plastics sleeve slipped over the card or paper to protect it. The labels can be provided in reel form on a backing sheet, peeled-off and applied to the band.

Suitable materials for the one-piece injection-molded identity bands described are polypropylene and polyethylene. Nylon and rubber are also suitable materials.

We calim:

1. An identity band capable of being formed into a loop, comprising an elongate strap portion having opposed major faces and a series of apertures therein, each aperture having two spaced apart transverse walls, one transverse wall of each aperture constituting a camming face and the other transverse wall of each aperture constituting a stop face, the camming and stop faces being skew to said major faces and thus both intersecting said major faces at angles other than right angles, and a latch portion adjacent one end of the band, the latch portion including a latch portion base and an arch formation including legs normal to the latch portion base and a cross-piece parallel to and spaced from the latch portion base, said legs, base and cross-piece defining a latching slot for receiving said strap portion, said latch portion base having an aperture therein and there being a displaceable latching element protruding from that one of the transverse walls of this aperture which is remote from said strap portion, said latching element extending into said slot, and said camming faces serving in turn to deflect said latching element out of said slot and into said aperture in said base while said strap portion is being passed through said slot in one direction to form the band into a loop, engagement between said latching element and any one of said stop faces preventing withdrawal of the strap portion from the slot in the opposite direction, a portion of the band being adapted to receive identification information.

2. An identity band according to claim 1, in which said latching element is in the form of a double wedge comprising a first portion adjacent said one transverse wall and a second portion extending from said first portion, the included angle between the converging faces of the first portion being greater than the included angle between the converging faces of the second portion.

3. A band according to claim 2, in which said arch formation and one of said major faces of said strap portion are on the side of the band which is directed outwardly when it is formed into a loop and the other major face of said strap portion is directed inwardly in this condition, the included angle between each camming face and said one major face being less than the included angle between each stop face and the other major face.

4. An identity band capable of being formed into a loop comprising an elongate strap portion having a series of apertures therein, each aperture having two spaced apart transverse walls, one transverse wall of each aperture constituting a camming face and the other transverse wall of each aperture constituting a stop face, and a latch portion adjacent one end of the band, the latch portion including a latch portion base and an arch formation including legs normal to the latch portion base and a cross-piece parallel to and spaced from the latch portion base, said legs, base and cross-piece defining a latching slot for receiving said strap portion, said latch portion base having an aperture therein and there being a displaceable latching element protruding from that one of the transverse walls of this aperture which is remote from said strap portion, said latching element extending into said slot and being in the form of a double wedge comprising a first portion adjacent said one transverse wall and a second portion extending from said first portion, the included angle between the converging faces of the first portion being greater than the included angle between the converging faces of the second portion and the thicker end of the double wedge being adjacent said one transverse wall, and said camming faces serving in turn to deflect said latching element out of said slot and into said aperture in said base while said strap portion is being passed through said slot in one direction to form the band into a loop, engagement between said latching element and any one of said stop faces preventing withdrawal of the strap portion from the slot in the opposite direction, a portion of the band being adapted to receive identification information.

5. An identity band according to claim 4, in which the surface of the latching element facing said cross-piece is planar, the surface facing said aperture in the latch portion base changing direction where said first and second portions merge.

6. An identity band capable of being formed into a loop comprising an elongate strap portion having opposed major faces and a series of apertures therein, each aperture having two spaced apart transverse walls, one transverse wall of each aperture constituting a camming face and the other transverse wall of each aperture constituting a stop face, the planes in which said transverse walls of the apertures lie being skew to the planes of the major faces of said strap portion and said camming and stop faces being skew to one another, and a latch portion adjacent one end of the band, the latch portion including a latch portion base and an arch formation including legs normal to the latch portion base and a cross-piece parallel to and spaced from the latch portion base, said legs, base and cross-piece defining a latching slot for receiving said strap portion, said latch portion base having an aperture therein and there being a displaceable latching element protruding from that one of the transverse walls of this aperture which is remote from said strap portion, said latching element extending into said slot, and said camming faces serving in turn to deflect said latching element out of said slot and into said aperture in said base while said strap portion is being passed through said slot in one direction to form the band into a loop, engagement between said latching element and any one of said stop faces preventing withdrawal of the strap portion from the slot in the opposite direction, a portion of the band being adapted to receive identification information.

7. A band according to claim 6, in which said arch formation and one of said major faces of said strap portion are on the side of the band which is directed outwardly when it is formed into a loop and the other major face of said strap portion is directed inwardly in this condition, the included angle between each camming face and said one major face being less than the included angle between each stop face and the other major face.

* * * * *